US005959269A

United States Patent [19]

Bauer et al.

[11] Patent Number: 5,959,269

[45] Date of Patent: Sep. 28, 1999

[54] ELECTRICAL ROTARY SWITCH

[75] Inventors: Karl-Heinz Bauer, Bad Neustadt; Ulrich Brueggemann, Heustreu; Walter Voll, Sandberg, all of Germany

[73] Assignee: Preh-Werke GmbH & Co. KG, Bad Neustadt/Saale, Germany

[21] Appl. No.: 09/076,912

[22] Filed: May 13, 1998

[30] Foreign Application Priority Data

May 16, 1997 [DE] Germany ..... 197 20 544

[51] Int. Cl.[6] ..... H01H 19/58

[52] U.S. Cl. ..... 200/11 R; 200/11 DA

[58] Field of Search ..... 200/11 R, 11 A, 200/11 B, 11 G, 565, 570, 571, 564, 277, 336

[56] References Cited

U.S. PATENT DOCUMENTS 3,394,236 7/1968 Grundig ..... 200/11
4,052,573 10/1977 Kojima et al. ..... 200/11 DA

FOREIGN PATENT DOCUMENTS 28 24 584 A1 12/1979 Germany .
89 12 785 U1 2/1990 Germany .

*Primary Examiner*—Michael L. Gellner
*Assistant Examiner*—Nhung Nguyen
*Attorney, Agent, or Firm*—Griffin, Butler, Whisenhunt & Szipl, LLP

[57] ABSTRACT

A rotary switch has a control knob (3) that is mounted on at least three balls (6) that move, guided by a cage disk (7), in a housing groove (8) formed by a radial wall (9) and an axial wall (10), against which the balls (6) are urged by an outward or inward conical bearing surface (11) or (12). The radial and axial wall bearing surfaces have contact segments and contact paths (13, 14) that are shorted by at least one of the balls (6). The control knob has a stop lug (15), an operational adjustment angle (4) of which is limited by housing lugs (16) and which, during operational adjustment, contacts at least one of two stop lugs (17) of the cage disk, which are positioned at an angle that corresponds approximately to one-half the maximum operational adjustment angle (4) and to a maximum contact adjustment angle (5). This structure results in reduced cost and functional improvement.

5 Claims, 2 Drawing Sheets

ELECTRICAL ROTARY SWITCH

BACKGROUND OF THE INVENTION

This invention relates to electrical rotary switches having control knobs positioned in housings.

German patent document DE 28 24 584 A1 discloses a rotary switch of this type, having surrounding contacts in a main body that are contacted by a tap member acting in a radial direction relative to a rotational axis.

This rotary switch is already available in a compact design, however a range of adjustment of a control knob thereof is not sufficiently large to permit sensitive adjustment.

German patent document DE 89 12 785 U1 discloses a tandem potentiometer in which a wiper is coupled via a step-down gear to a drive shaft so that one of the wipers is adjusted by a smaller angle than an angle of movement of the drive shaft. This makes possible a more sensitive adjustment of the potentiometer.

The step-down gear is said to be formed by a planet wheel gear, whereby the wiper referenced above is connected to a planet wheel located between gearing of the drive shaft and a stationary, concentric gear wheel.

Based on the foregoing, it is an object of this invention to develop a rotary switch of the type mentioned in the opening paragraph with which sensitive adjustment can be obtained at reduced construction expenses.

SUMMARY OF THE INVENTION

According to principles of this invention a control knob of an electrical rotary switch rides on at least three balls that move, guided by a cage disk, in a housing groove formed by a radial wall and an axial wall, against which the balls are urged by load pressure of a conical bearing surface, with the radial and axial wall bearing surfaces having contact segments and contact paths that are shorted by at least one of the balls. The control knob has a stop lug, an operational adjustment angle of which is limited by two housing lugs and which, during operational adjustment, contacts at least one of two stop lugs of the cage disk, which are positioned at an angle that corresponds approximately to one-half of a maximum operational adjustment angle or a maximum contact adjustment angle.

BRIEF DESCRIPTION OF THE DRAWING

The invention is described and explained in more detail below using embodiments shown in the drawings. The described and drawn features, in other embodiments of the invention, can be used individually or in preferred combinations. The foregoing and other objects, features and advantages of the invention will be apparent from the following more particular description of preferred embodiments of the invention, as illustrated in the accompanying drawings in which reference characters refer to the same parts throughout the different views. The drawings is not necessarily to scale, emphasis instead being placed upon illustrating principles of the invention in a clear manner.

FIG. 5 is a simplified cross sectional view of the rotary switch of FIG. 2, taken on a plane perpendicular to the plane of the paper on which FIG. 2 is drawn.

DETAILED DESCRIPTION OF A PREFERRED EMBODIMENT

Figure 1:
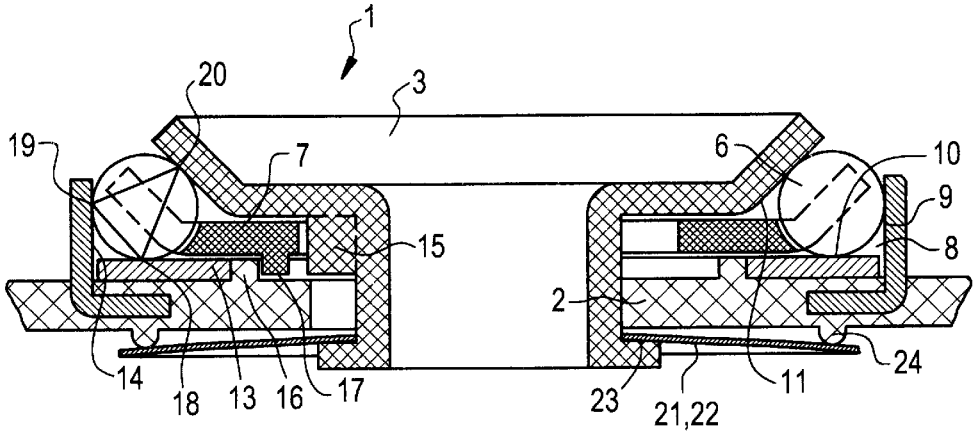
FIGS. 1 through 4 are cross sectional views of preferred embodiments of a rotary switch according to this invention.
Figure 2:
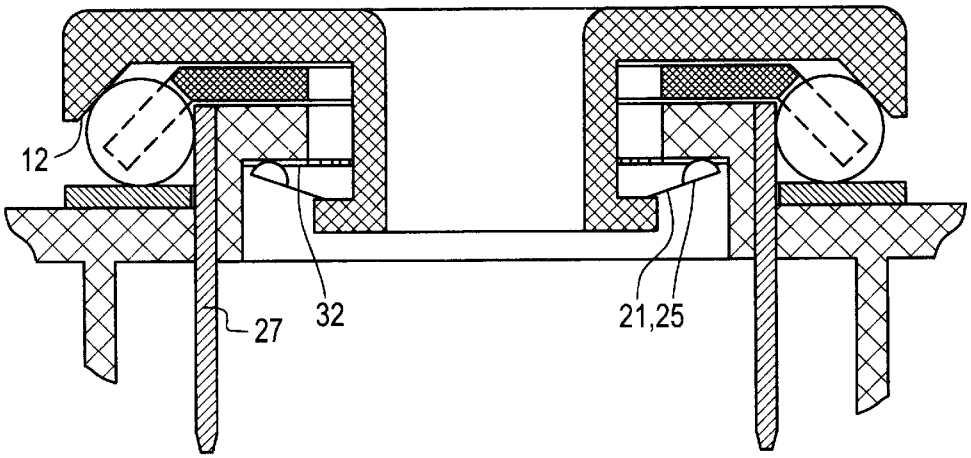

FIG. 1 shows a cross section of an electrical rotary switch 1 having a control knob 3 mounted in a housing 2, a maximum operational adjustment angle 4 of which is larger than a maximum contact adjustment angle 5, as explained in further detail below with reference to FIG. 5. The control knob 3 is mounted on at least three balls 6 that move, guided by a cage disk 7, in a housing groove 8 formed by a radial wall 9 and an axial wall 10, against which the balls 6 are urged by a load pressure of an outward conical bearing surface 11 of the control knob 3. FIG. 2 shows an alternative embodiment in which an inward conical bearing surface 12 is provided. These two embodiments of the bearing make low-friction adjustment of the control knob 3 possible.

The radial and axial wall bearing surfaces have contact segments and contact paths 13, 14 that are shorted by at least one of the balls 6 when in predetermined controller positions. The balls 6 are made of a highly conducting material and can be coated with a precious metal. In this manner, contact bridges, wipers, etc. used previously are now omitted, making this design extraordinarily less expensive.

Figure 5:
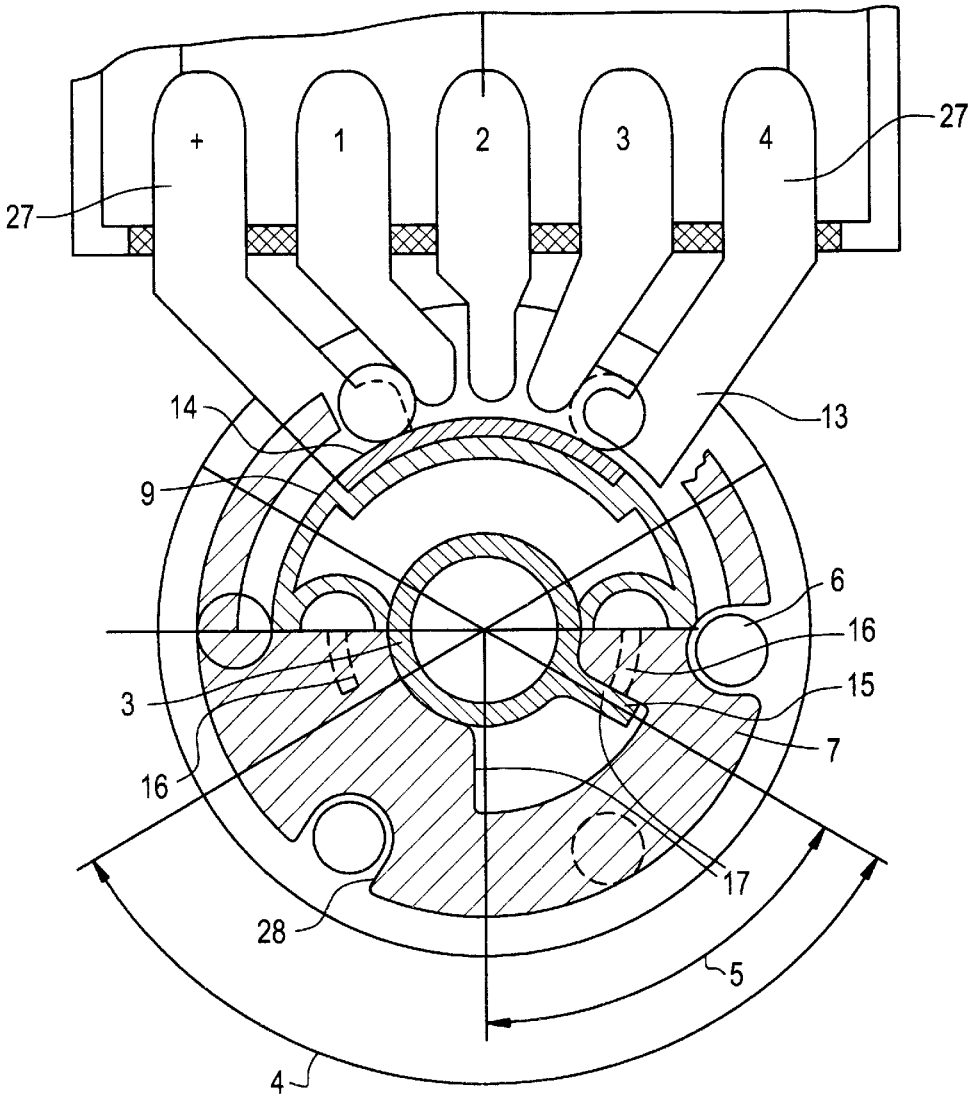

The control knob 3 has a stop lug 15, the operational adjustment angle 4 of which is limited by housing lugs 16, as shown in FIG. 5. During operational adjustment, this stop lug 15 contacts at least one of two stop lugs 17 of the cage disk 7, which are positioned at an angle that corresponds approximately to one-half the maximum operational adjustment angle 4, or to the maximum contact angle 5. A deviation of the angle from an angle that can be theoretically achieved in a ratio of 100% to 50% can be determined by experiment or by calculation. It has been shown that differently sized paths traced by contact points of the outward conical bearing surface 11 with the balls 6 and a center of the balls 6, and differently sized paths traced by contact points of the inward conical bearing surface 12 with the balls 6 and a center of the balls 6, increase (approximately 100% to 56%) or decrease (approximately 100% to 38%) this ratio.

The invention is based on the recognition that a ball or roller on which an object rolls, rolls at half the speed as the object, or moves only half the distance as the object. In this manner, in the described embodiments of the rotary switch 1, a stepping-down of a manipulation movement (or adjustment) of the control knob 3 to a movement (or adjustment) of the balls 6, or to adjustment of the cage 7 that guides the balls, is achieved, without requiring gear wheels, for example.

It is known that in rolling bearings, a combined type of rolling and sliding occurs, whereby the sliding is characterized as microslippage. In the present rotary switch 1, microslippage is intensified by differently-sized roll circles of the ball support points 18, 19, 20, shown in FIG. 1, which are balanced by gliding of the balls 6 on the contact segments and contact paths 13, 14.

In this manner, self-wiping of the contact segments and contact paths 13 and 14 takes place, which makes possible use of the balls 6 as short circuiting transfer elements.

This microslippage, however, also means that the theoretically available step-down ratio is not maintained in certain circumstances. However, the stop lugs 17 on the cage disk 7 serve this purpose. These lugs ensure that the cage disk 7, and thus the balls 6, are always pulled along by the stop lug 15 of the control knob 3, up to the housing lugs 16, i.e. a respective new adjustment always takes place.

A load pressure of the outward or inward conical bearing surfaces 11 or 12 is created by one or more springs 21 mounted between the housing 2 and the control knob 3. For this purpose, in FIG. 1, a curved washer 22 is provided that is supported on a collar 23 of the control knob 3 and an engagement collar 24 of the housing 2 when flexed in its installed position.

FIG. 2 shows an embodiment of the spring 21 with spring arms 25.

Figure 3:
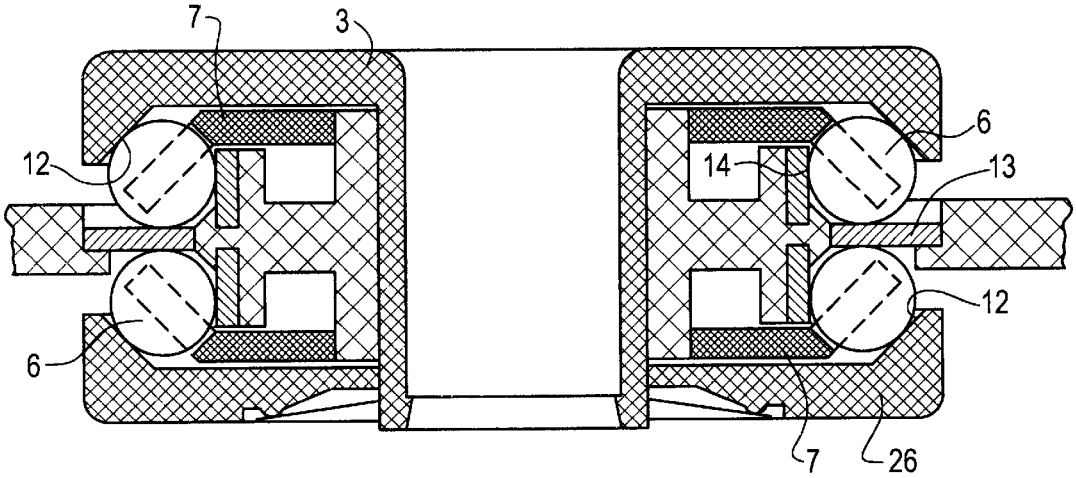

FIG. 3 shows a spring as in FIG. 1, wherein the curved washer 22 rests on a fitted closing ring 26 instead of on the housing 2.

The embodiments shown in FIGS. 1 and 2 differ from one another by the structures of their respective outward and inward conical bearing surfaces 11 and 12. FIG. 1 shows the structure having the outward conical bearing surface 11, in which the radial wall 9 of the housing 2 faces inwardly, and FIG. 2 shows the structure having the inward conical bearing surface 12, in which the radial wall 9 faces outwardly.

FIG. 3 shows an embodiment in which contacting occurs on both sides with balls 6, contact paths 14, and inward conical bearing surfaces 12 being on both sides of the contact segments 13, with one inward conical bearing surface 12 being on a closing ring 26 fitted onto the control knob 3.

It is provided that the contact segments 13 and the contact paths 14 lead out of the housing 2 via terminal lugs 27. FIG. 5 shows a section through the control knob 3 and the housing 2 of FIG. 2, in which the balls 6 are shown within guide recesses 28 of the cage disk 7. Similarly shown are the maximum operational adjustment angle 4 of the control knob 3 limited by the housing lugs 16, and the maximum contact angle 5 that corresponds to one-half the maximum operational adjustment angle 4, at which the stop lugs 17 of the cage disk 7 are positioned.

It is evident that during operational adjustment, the stop lug 15 moves away from one housing lug 16 in a direction of one stop lug 17 of the cage disk 7 and the other housing lug 16, whereby the cage disk 7, that is its corresponding stop lug 17 which moves along at approximately half the speed, is not caught by the stop lug 15 of the control knob 3 until the stop lug 15 nears or strikes the housing lug 16.

Figure 4:
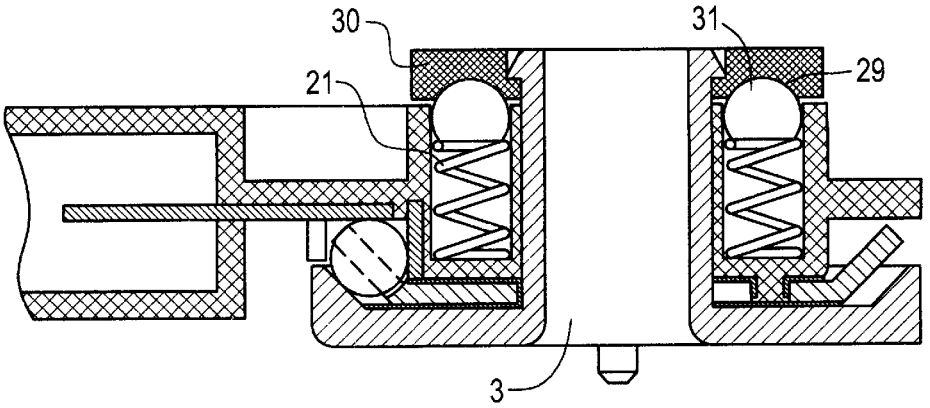

FIG. 4 shows an embodiment in which there is a spring arrangement that simultaneously forms an indexing mechanism for the control knob 3, including indentations 29 in the control knob 3 or in a closing ring 30 fitted onto the control knob 3 and at least one ball 31, the ball 31 being urged by a spring 21 acting between the housing 2 and control knob 3.

Otherwise the control knob 3 can have an indexing mechanism that employs indexing teeth 32 of the housing 2, or of the control knob 3, into which the spring arms 25 of the spring 21, which is tensioned between the housing 2 and the control knob 3, engage for achieving adjustment locking.

One of the terminal lugs 27 extending outwardly from the housing 2 makes possible electrical connection of the contact path 14 to a positive pole of a voltage source. A load can be switched "on" via a terminal lug 27 of a contact segment 13.

The invention is not limited to the embodiments presented; several balls and several contact paths can be provided, without exceeding the scope of the invention.

The invention claimed is:

1. An electrical rotary switch comprising:

a housing defining an annular housing groove formed by a radially facing wall and an axially facing wall;

a control knob mounted in the housing for movement relative to said housing;

at least three balls positioned and moving in the housing groove, said balls contacting the radially and axially facing walls and supporting the control knob, said balls being urged by load pressure of a conical bearing surface of one of the control knob and the housing against the radially and axially facing walls, and said balls being caused to rotate in said housing groove by movement of the control knob;

a cage disk positioned in the housing groove for guiding the balls and moving with the balls in the housing groove;

wherein each of the radially and axially facing walls respectively has an electrical contact member thereon, said contact members being short circuited by at least one of the balls;

wherein the control knob has at least first and second control-knob stop-lug portions, and wherein said housing includes two housing lugs for defining an operational adjustment angle of the control knob on the housing by contacting the first control-knob stop-lug portion, and wherein said cage disk has two cage-disk stop lugs for contacting the second control-knob stop lug portion during operational adjustment of said control knob, said cage-disk stop lugs being positioned at an angle relative to each other that corresponds approximately to one-half the operational adjustment angle of the control knob.

2. An electrical rotary switch as in claim 1, wherein a load pressure of the conical bearing surface urging the balls against the radially and axially facing walls is created by at least one spring mounted between the housing and the control knob.

3. An electrical rotary switch as in claim 2, wherein the electrical contact members extend out of the housing to form terminal lugs outside the housing.

4. An electrical rotary switch as in claim 3, wherein the control knob has a switch-position indexing mechanism that is formed by indentations in a member engaged to one of the control knob and housing and at least one ball, with the ball being urged by a spring acting between the housing and the control knob into the indentations.

5. Electrical rotary switch as in claim 2, wherein the control knob has an indexing mechanism that includes teeth on one of the housing and control knob, and spring arms of the spring positioned between the housing and the control knob engage in the teeth.

* * * * *